US006572458B2

(12) United States Patent
Lim

(10) Patent No.: US 6,572,458 B2
(45) Date of Patent: Jun. 3, 2003

(54) DEVICE FOR REMOVING BURRS FROM WORKPIECE

(75) Inventor: Jae-Muk Lim, Pyungteak-shi (KR)

(73) Assignee: Kia Motors Corporation, Seoul (KR)

( * ) Notice: Subject to any disclaimer, the term of this patent is extended or adjusted under 35 U.S.C. 154(b) by 1 day.

(21) Appl. No.: 09/845,172

(22) Filed: May 1, 2001

(65) Prior Publication Data

US 2002/0016141 A1 Feb. 7, 2002

(30) Foreign Application Priority Data

Aug. 2, 2000 (KR) ..... 2000-44732

(51) Int. Cl.[7] ..... B24B 31/02
(52) U.S. Cl. ..... 451/113; 451/106
(58) Field of Search ..... 451/113, 104, 451/106, 326, 327, 330, 36

(56) References Cited

U.S. PATENT DOCUMENTS

| | | | | |
|---|---|---|---|---|
| 2,425,640 A | * | 8/1947 | Pruitt et al. | 451/113 |
| 2,720,730 A | * | 10/1955 | Kroger | 451/113 |
| 2,899,777 A | * | 8/1959 | Davidson | 451/113 |
| 3,516,203 A | * | 6/1970 | Hambright | 451/113 |
| 3,570,183 A | * | 3/1971 | Ferrara | 451/113 |
| 3,599,374 A | * | 8/1971 | Porter | 451/106 |
| 4,173,851 A | * | 11/1979 | Higashi | 451/113 |
| 4,730,417 A | * | 3/1988 | Davidson et al. | 451/113 |
| 5,020,350 A | | 6/1991 | Knepp et al. | |
| 5,445,556 A | | 8/1995 | Miura | |
| 5,456,312 A | | 10/1995 | Lynde et al. | |
| 5,810,079 A | | 9/1998 | Lynde et al. | |
| 5,899,268 A | | 5/1999 | Lynde et al. | |

FOREIGN PATENT DOCUMENTS

| | | | | |
|---|---|---|---|---|
| EP | 0925875 | | 6/1999 | |
| SU | 1013230 | * | 4/1983 | 451/330 |
| WO | WO9908836 | | 2/1999 | |

* cited by examiner

*Primary Examiner*—Robert A. Rose
(74) *Attorney, Agent, or Firm*—Birch, Stewart, Kolasch & Birch, LLP

(57) ABSTRACT

Disclosed is a device for removing burrs from a workpiece, in which a barrel having an inner and an outer barrels is located within a frame constituting a main body of the device. The inner barrel contains a plurality of media for removing the burrs from the workpiece, and the outer barrel is supplied with a coolant for cooling the media and the workpiece. The outer barrel is also provided with a coolant drain duct for discharging the used coolant. A spindle is provided at its lower end with a chuck for clamping the workpiece. When the workpiece is clamped into a chuck and is positioned within the inner barrel so as to be deburred by the media, the spindle is rotated in regular and reverse direction by a rotary motor, and is moved upward and downward by an elevating motor. In addition to this, the inner barrel reciprocates in a right and left direction by a shaker. The burrs removed from the workpiece are discharged together with the coolant.

11 Claims, 12 Drawing Sheets

DEVICE FOR REMOVING BURRS FROM WORKPIECE

BACKGROUND OF THE INVENTION

1. Field of the Invention

The present invention relates to a device for removing burrs from a workpiece, and more particularly to a device for removing burrs from a workpiece requiring high precision, such as, a clutch drum for an automatic transmission.

2. Description of the Related Art

In general, pluralities of parts constituting one device are made of metallic or non-metallic materials to be worked by predetermined working methods. Although there are some metallic parts which do not produce burrs owing to being made by non-cutting work such as casting, forging and so forth, the burrs are inevitably produced when parts are made by cutting work such as lathe turning, drilling and so on. Such burrs are a small matter in case of parts not requiring high precision, but the burrs must be removed in case of parts requiring high precision because the burrs have a bad effect on actions of the device.

As shown in FIG. 1, for example, a clutch drum W for an automatic transmission is first made in a predetermined shape by casting, and then teeth G, oil holes H, etc. are cutting-worked on inner and outer circumferential surfaces of the clutch drum W. At this time, burrs which are produced when the teethes G and the oil holes H are cutting-worked must be removed because they injure parts corresponding to the clutch drum W or adhere to the corresponding parts due to a high temperature on operation of the automatic transmission to give rise to a trouble of the automatic transmission.

FIG. 2 shows a schematic view of a conventional device for removing burrs from a clutch drum for an automatic transmission (hereinafter generally referred as "workpiece"). As shown in FIG. 2, the workpiece W is chucked in a chuck 2 mounted at an end of a spindle 1, and a disk-like brush 5 is fixed to a brushing unit 4 provided on an X-Y table 3 and is driven. The workpiece W and the brush 5 are rotated in opposite directions relative to each other, and the brush 5 ascends and descends as well as moves forward and backward by the X-Y table 3. The Burrs of the workpiece W are removed by these actions of the brush 5.

The conventional device for removing burrs from a workpiece W having above mentioned structure, however, is so constructed that the ordinary brush 5 removes the burrs, and has the following problems:

Firstly, the brush 5 gradually changes in shape with increase of frequency of use of the device, which deteriorates brushing function of the brush 5 and so results in impossibility of effective removal of the burrs.

Secondly, the residual burrs must be manually removed in loading process of the workpiece W because the burrs cannot be removed effectively. As a result of this, labor cost goes higher due to increase of labor force.

Thirdly, since inaccuracy in upward-downward movement and forward-backward movement of the brushing unit 4 brings a collision between the workpiece W and the brush 5, shutdown of the device frequently occurs and thus the overall rate of operation is lowered.

Fourthly, life span of the brush 5 is very short enough to require frequent exchange of the brush 5, and so lowering in the rate of operation of the device is caused.

Fifthly, the burrs are piled up as they are due to nonexistence of chip removal means, which is accompanied with troublesome periodic disposal of the piled burrs by an operator.

SUMMARY OF THE INVENTION

Accordingly, the present invention has been made considering the above-stated problems, and it is an object of the present invention to provide a device for removing burrs from a workpiece, which can reliably remove the burrs of the workpiece without deformation of a tool with increase of frequency of use so as to require no additional removal operation by an operator.

It is another object of the present invention to provide a device for removing burrs from a workpiece, in which not only exchange of a tool is not needed, but also there occurs no shutdown of the device due to collision interference of the tool, and so the rate of operation of the device can be increased.

It is further another object to provide a device for removing burrs from a workpiece, which can reliably discharge the removed burr of the workpiece out of the device.

To achieve the above-mentioned objects, there is provided a device for removing burrs produced by cutting work from a workpiece in accordance with the present invention, the device comprising:

- a frame constituting a main body of the device;
- a barrel being located within the frame, receiving a plurality of media for removing the burrs from the workpiece, being supplied with a coolant for cooling the media and the workpiece, and being provided with a coolant drain duct for discharging the used coolant;
- a spindle extending from the frame toward the barrel and having a chuck for clamping the workpiece at its lower end;
- means for rotating the spindle in regular and reverse directions, being spline-coupled to the spindle;
- means for elevating the spindle so as to raise and lower the workpiece by a certain stroke within the barrel, being installed in the frame; and
- means for reciprocating the barrel in a horizontal direction.

The means for rotating the spindle includes a regular and reverse driving-rotary motor disposed in a upper portion of the frame, a diving pulley disposed in the rotary motor, and a driven pulley spline-coupled to the spindle and connected to the driving pulley via a transmission belt.

Also, the means for elevating the spindle includes a pair of guide rails disposed up and down in the frame, an elevator plate guided along the guide rails and connected to the spindle, a ball screw spirally coupled to the elevator plate, and an elevating motor disposed in the frame so as to drive the ball screw in regular and reverse directions.

Moreover, the means for reciprocating the barrel includes a guide road movably disposed in the frame so as to support the barrel, and a shaker reciprocating the guide road by a certain stroke.

Meanwhile, the barrel has an outer barrel fixed to the frame and receiving the coolant, an inner barrel movably located within the outer barrel, filled with the media and provided on its outer circumferential surface with a plurality of through holes, and a door for opening and closing a upper opening of the outer barrel by operation of a door cylinder disposed in the frame.

The door has a pair of door members cooperating with each other by the door cylinder, the door members are provided with an internal teeth member having a symmetrical shape to each other, respectively, and the internal teeth members form a jig on which the workpiece is securely seated.

Surfaces of the door members confronting each other are formed with semi-circular recesses each of which has a radius slightly larger than that of the spindle.

Preferably, the device for removing burrs from a workpiece according to the present invention further includes a loader for securely seating the workpiece conveyed by a conveyor on the jig and taking out the workpiece after completion of deburring.

The outer barrel is preferably provided on its inner surface with coolant-supplying nozzles for supplying the coolant and on its bottom surface with a drain valve for opening and closing the coolant drain duct.

The outer barrel also has a level sensor for detecting a level of the coolant in the outer barrel, and a coolant overflow tube for bypassing the coolant into the coolant drain duct when the coolant overflows.

It is preferred that the media are formed of cemented carbide alloys and have a polygonal shape.

A volume ratio between the outer barrel and inner barrel is preferably about 8:2.

BRIEF DESCRIPTION OF THE DRAWINGS

The above objects, and other features and advantages of the present invention will become more apparent from the following detailed description in conjunction with the drawings, in which.

DETAILED DESCRIPTION OF PREFERRED EMBODIMENTS

Hereinafter, a preferred embodiment of a linear compressor according to the present invention will be described with reference to the accompanying drawings.

Figure 1:
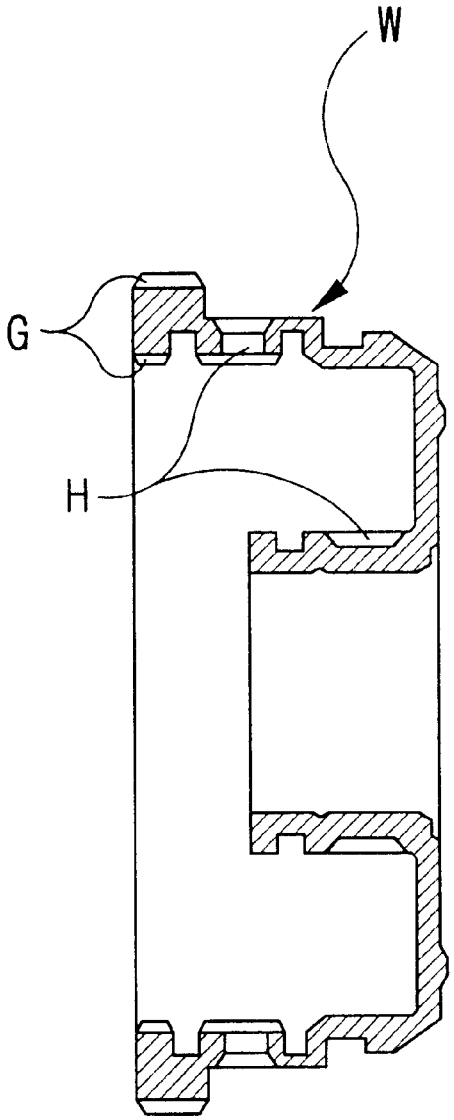
FIG. 1 is a sectional view of a clutch drum for an automatic transmission as an example of a workpiece.
Figure 2:
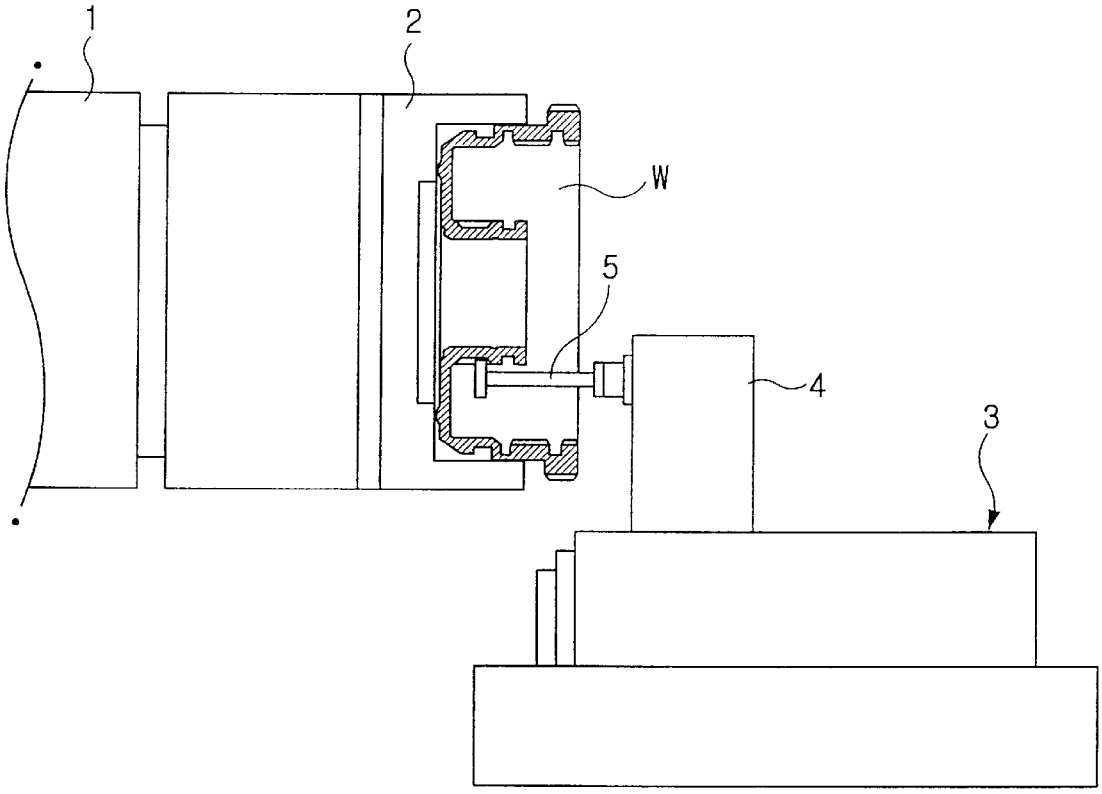
FIG. 2 PRIOR ART
FIG. 2 is a schematic side view of a conventional device for removing burrs from a workpiece.
Figure 3:
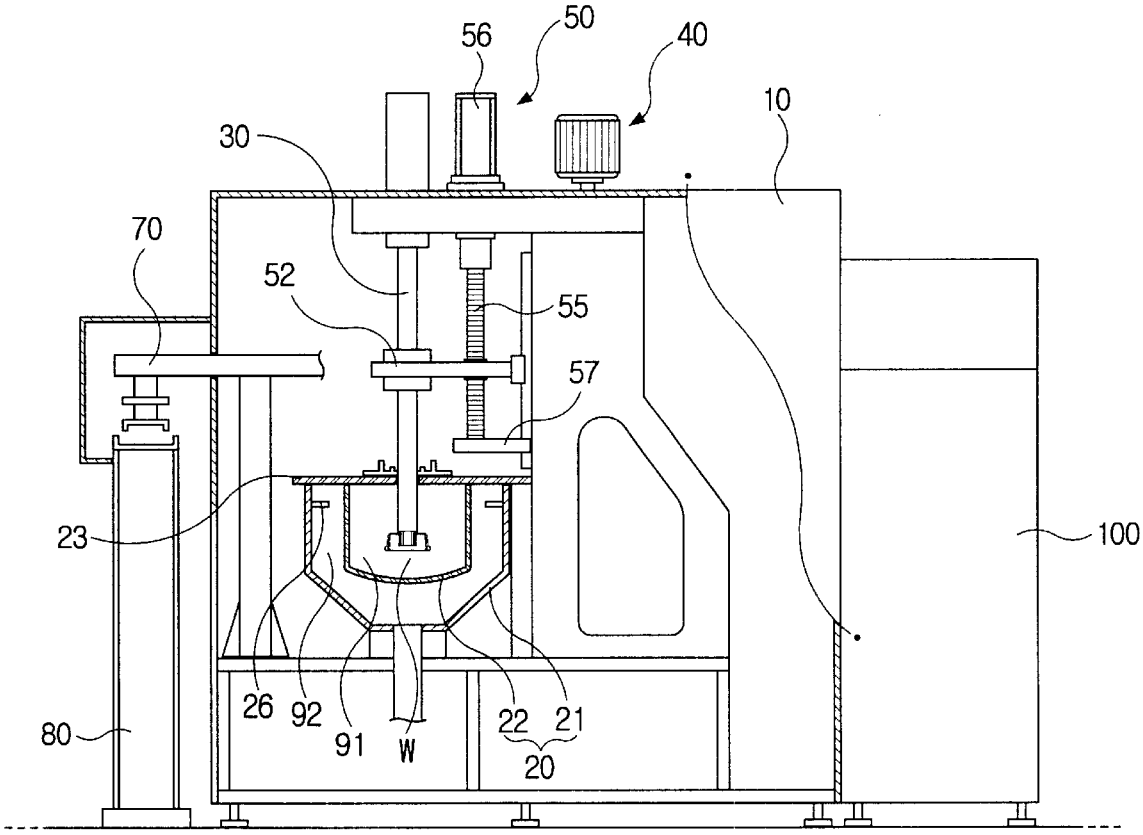
FIG. 3 is a schematic front view cut in part of a device for removing burrs from a workpiece according to the present invention.
Figure 4:
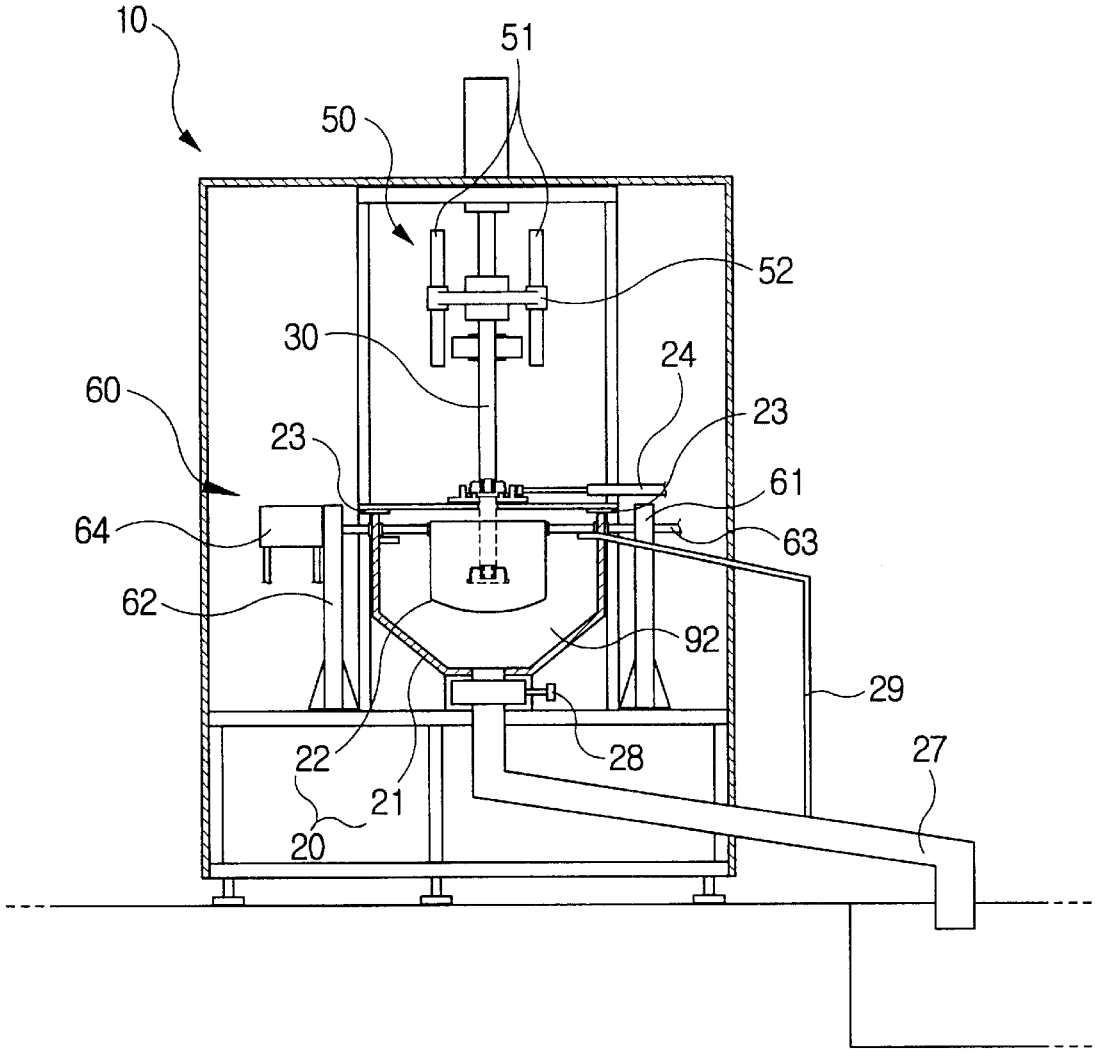
FIG. 4 is a schematic sectional side view of the device for removing burrs from a workpiece according to the present invention.

Referring to FIG. 3 and FIG. 4, a device for removing burrs from a workpiece according to the present invention comprises a frame 10, a barrel 20 located in the frame 10 and within which mixture of a plurality of media 91 having a predetermined shape and a coolant 92 is received, a spindle 30 by which the workpiece W to be deburred is grasped and which rotates and rises and falls within the barrel 20, a rotating unit 40 for reversibly driving the spindle 30 at regular intervals, an elevating unit 50 for raising and lowering the spindle 30 by a certain stroke, and a sliding unit 60 for reciprocating the barrel 20 in a horizontal direction.

Figure 11:
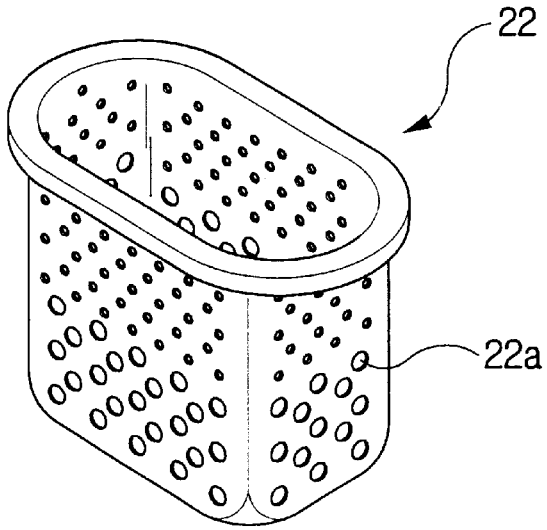
FIG. 11 is a perspective view of an inner barrel.

The barrel 20 has an outer barrel 21 filled with the coolant 92, an inner barrel 22 received within the outer barrel 21 and filled with a plurality of the media 91, and a door 23 for opening and closing upper openings of the outer and inner barrels 21, 22. As shown in FIG. 11, the inner barrel 22 is provided on its outer circumferential surface with a plurality of through holes 22*a* through which the coolant 92 filled within the outer barrel 21 flows into the inner barrel 22. Thus, the media 91 is in a state of being contained within the coolant 92.

Theses through holes 22*a* are preferably formed in a large size within the limit that the media 91 filled within the inner barrel 22 do not escape from the inner barrel 22. The outer barrel 21 is fixed to the frame 10, and the inner barrel 22 is reciprocated in a horizontal direction within the outer barrel 21 by the sliding unit 60 as shown in FIG. 21. A volume ratio between the outer barrel 21 and the inner barrel 22 is about 8:2.

Figure 9:
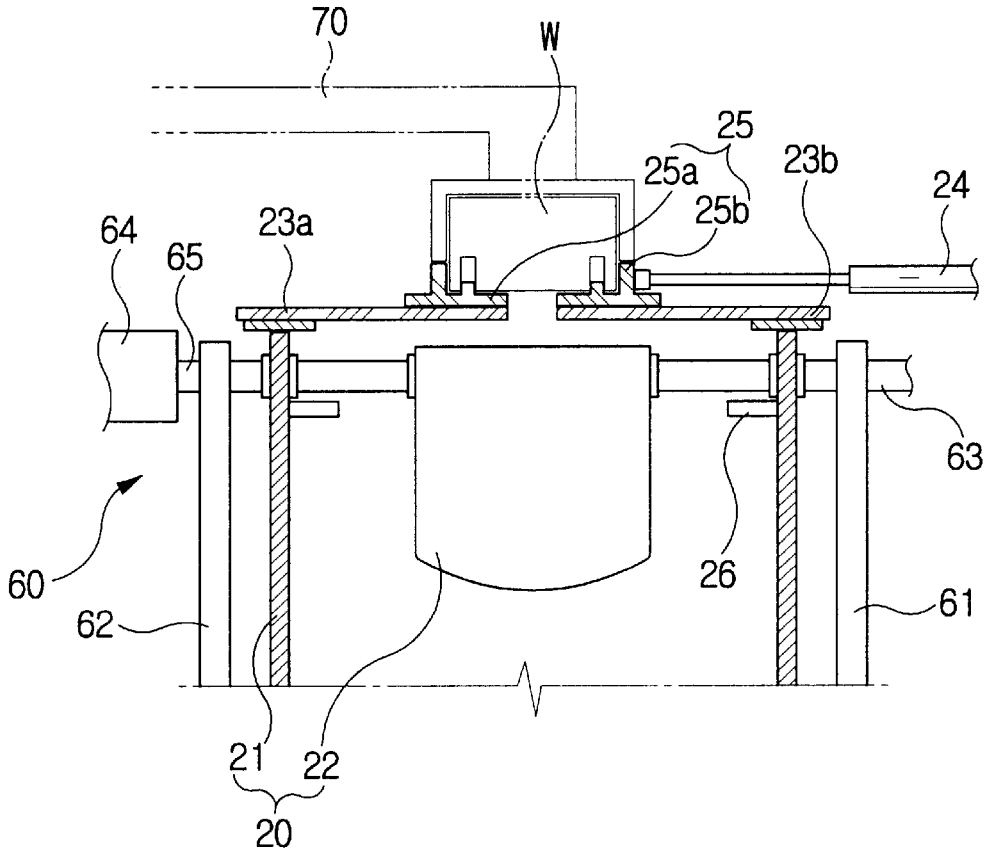
FIG. 9 is a sectional view for illustrating a opening and closing structure of a door.

As particularly shown in FIG. 9, the sliding unit 60, for example, includes a pair of guide rods 63 (only one of them is shown in FIG. 9) movably supported by supporters 61, 62 provided on both sides of the frame 10, and a shaker 64 disposed in the supporter 62 on one side of the frame 10. A rod 65 extending horizontally from the shaker 64 toward the outer barrel 21 is connected to the guide rod 63 so that the guide rod 63 reciprocates by operation of the shaker 64. The inner barrel 22 is connected to the guide rod 63, and is conveyed right and left when the guide rod 63 reciprocates by the operation of the shaker 64 as seen from FIG. 9.

The door 23 consists of a pair of door members 23*a*, 23*b* which cooperate with each other so as to open and close the upper opening of the outer barrel 21 by operation of a door cylinder 24 disposed in the frame 10. Each of the door members 23*a*, 23*b* is formed in a portion confronting each other with a semi-circular recess. Thus, the door members 23*a*, 23*b* are moved in directions away from each other and the spindle 30 is introduced into the inner barrel 22 through an aperture formed by the semi-circular recesses when a piston of the door cylinder 24 is operated to be retreated.

Also, as shown well in FIG. 9, the door 23 is integrally provided on its upper surface with a jig 25 on which the workpiece W is securely seated for a while. Similarly to the door 23, the jig 25 consists of a pair of internal teeth members 25*a*, 25*b* which cooperate with each other and together with the door members 23*a*, 23*b* of the door 23. This jig 25 has a workpiece sensing sensor (not shown) for detecting whether the workpiece W is securely seated on the jig 25 or not, and the sensor is ultimately intended to control driving of the elevating unit 50 by detection of the workpiece W.

Figure 10:
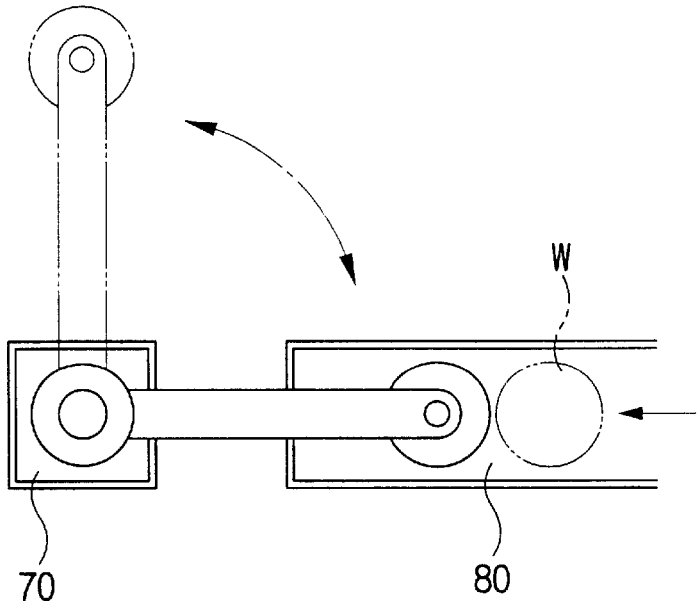
FIG. 10 is a schematic plan view for illustrating a loading structure of the workpiece.

When the sensor detects that the workpiece W is not in the jig 25, a loader 70 as shown in a double chain line is provided from one side of the frame 10 in order to securely seat the workpiece W on the jig 25. The loader 70 is so operated not only as to grasp the workpiece W conveyed in a predetermined position by a conveyor 80 and securely seat it on the jig 25 as shown in FIG. 10, but also as to take out the deburred workpiece W by a discharge conveyor (not shown).

On the other hand, a plurality of coolant supplying nozzles 26 for supplying the coolant 92 into the outer barrel 21 are provided in a upper portion of an inner surface of the outer barrel 21 and are connected to an external coolant supplying tank (not shown), and the outer barrel 21 is provided with a level sensor (not shown) for detecting a level the coolant 92 in the outer barrel 21 and controlling the coolant supplying sensor 26. Also, a drain duct 27 for draining the coolant 92 is connected to a bottom of the outer barrel 21. The drain duct 27 is selectively opened or closed by a drain valve 28 disposed in a lower portion of the outer barrel 21. In addition, the outer barrel 21 has a coolant overflow tube 29 for bypassing the coolant 92 into the coolant drain duct 27 when the coolant 92 overflows.

The spindle 30 for grasping the workpiece W is vertically arranged above the barrel 20, and a chuck 31 for clamping the workpiece W securely seated on the jig 25 is provided at a lower end of the spindle 30. Because the spindle 30 is to be moved upward and downward simultaneously with to be rotated as stated above, as shown in FIG. 5 to FIG. 8, splines 32 are formed on a upper outer circumferential surface of the spindle 30 so as to transmit rotating force from the rotating unit 40 to the spindle 30, and a flange 33 is provided in a middle portion of the spindle 30.

Figure 5:
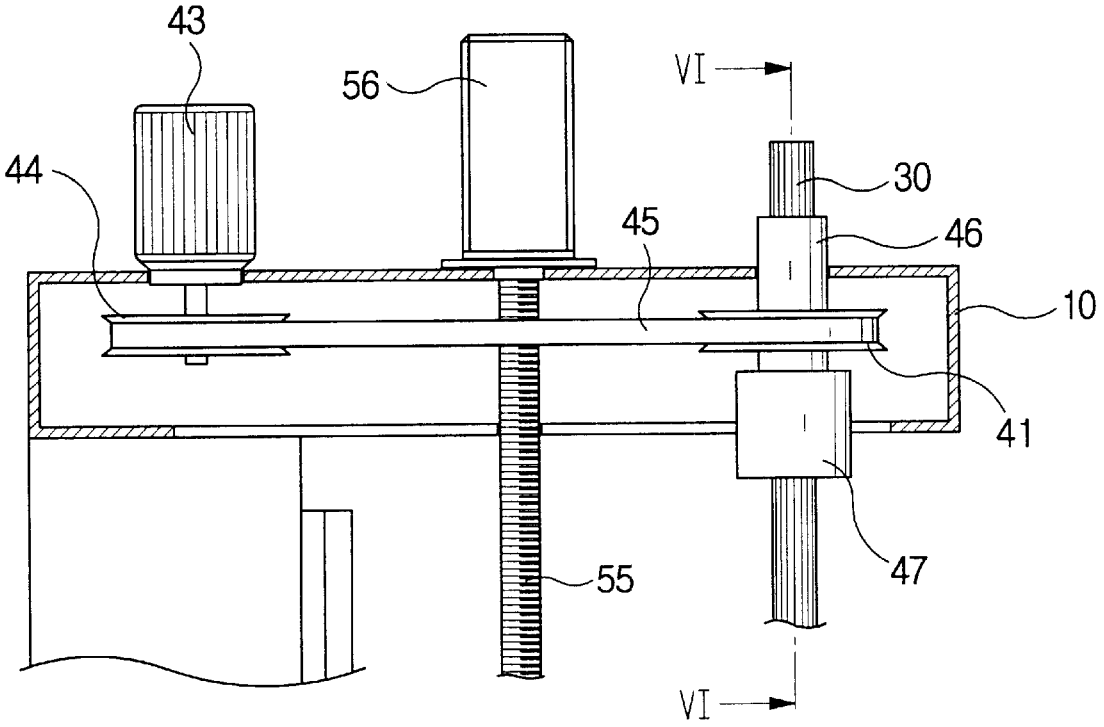
FIG. 5 is a side view cut in part of a workpiece driving part extracted from FIG. 3.
Figure 6:
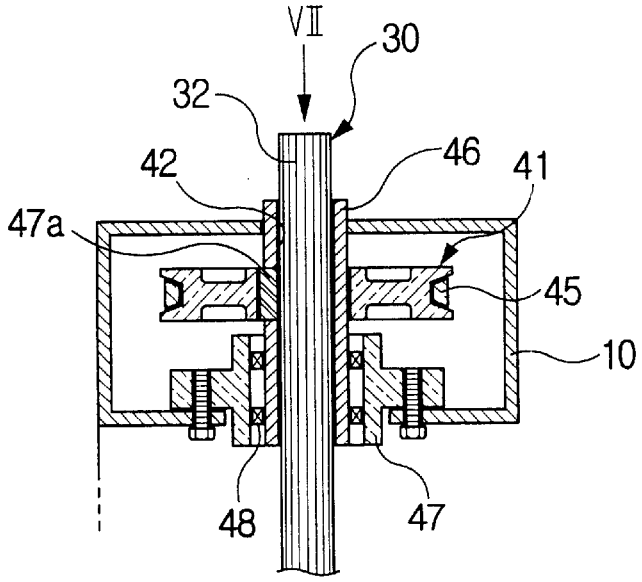
FIG. 6 is a sectional view taken along line VI—VI in FIG. 5.
Figure 7:
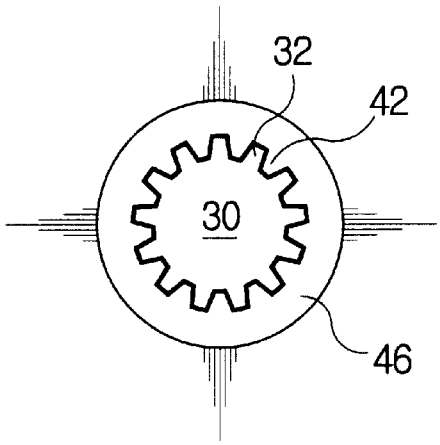
FIG. 7 is a plan view of an essential part taken along line VII in FIG. 6.

Corresponding to this, the rotating unit 40 includes a regular and reverse driving motor 43 disposed in a upper portion of the frame 10, a driving pulley 44 disposed in the driving motor 43, and a driven pulley 41 connected to the driving pulley 44 via a transmission belt 45 as shown in FIG. 5 and FIG. 6. The regular and reverse driving motor 43 is rotated in regular and reverse directions for a predetermined time. The driven pulley 41 is rotatably supported to the frame 10.

As seen from FIG. 6 in detail, the driven pulley 41 is integrally fixed to a sleeve 46 vertically penetrating a center of the driven pulley 41 and a key member 47*a*, and the sleeve 46 has splines 42 to be engaged with the splines 32 formed in the spindle 30. Also, an outer circumferential surface of the sleeve 46 is rotatably supported via a bearing 48 to a supporting boss 47 fixed to the frame 10. Therefore, the rotary driving force of the regular and reverse driving motor 43 can be transmitted to the spindle 30 via the driven pulley 41 and the sleeve 46, and so the spindle 30 can be driven to be rotated by the regular and reverse driving motor 43, and be slid in a up and down direction by the elevating unit 50 on the other hand owing to the spline-coupling to the sleeve 46 as described above.

Figure 13A:
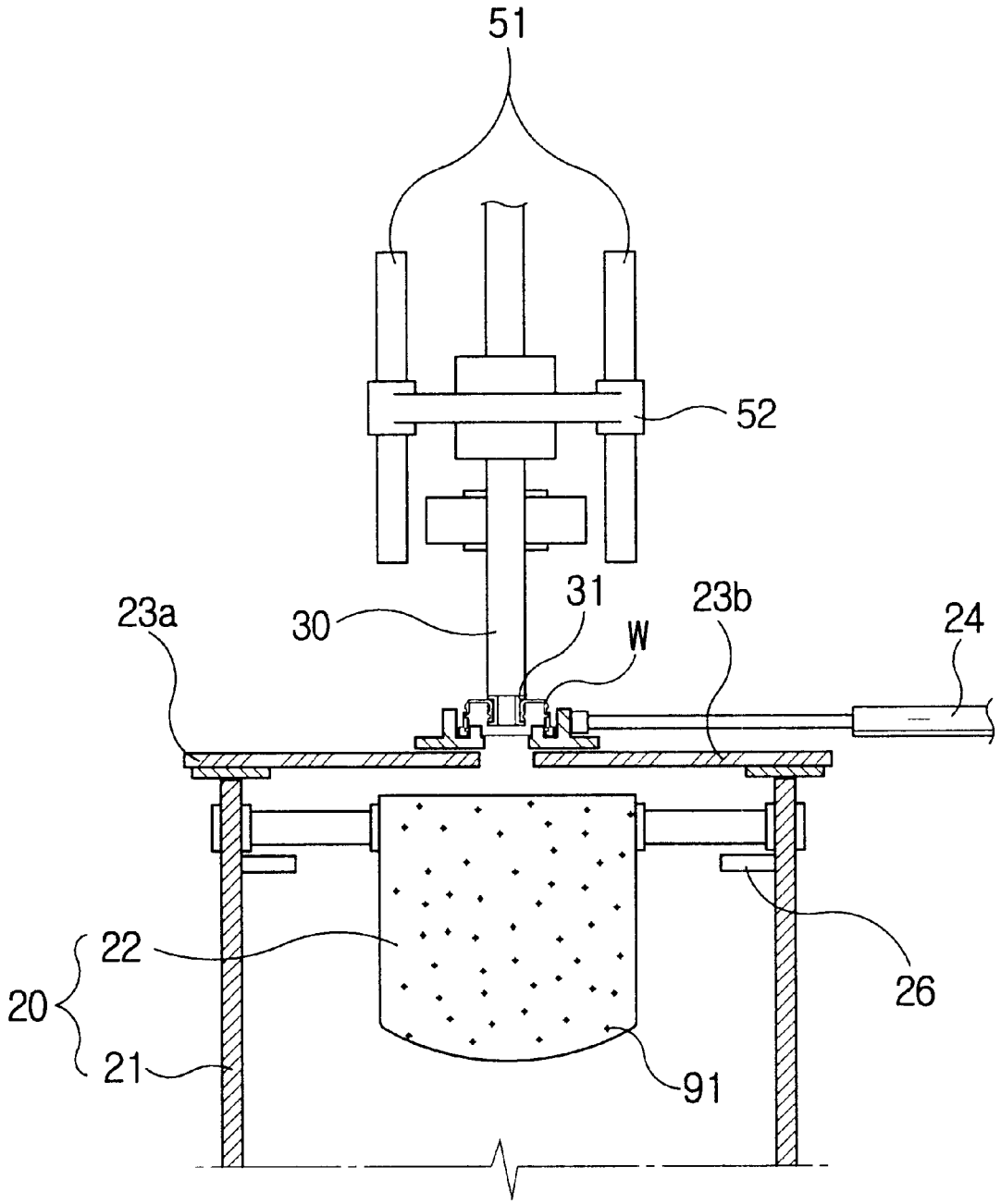
FIG. 13*a* to FIG. 13*c* are views showing processes for receiving the workpiece into a media box in sequence.
Figure 13B:
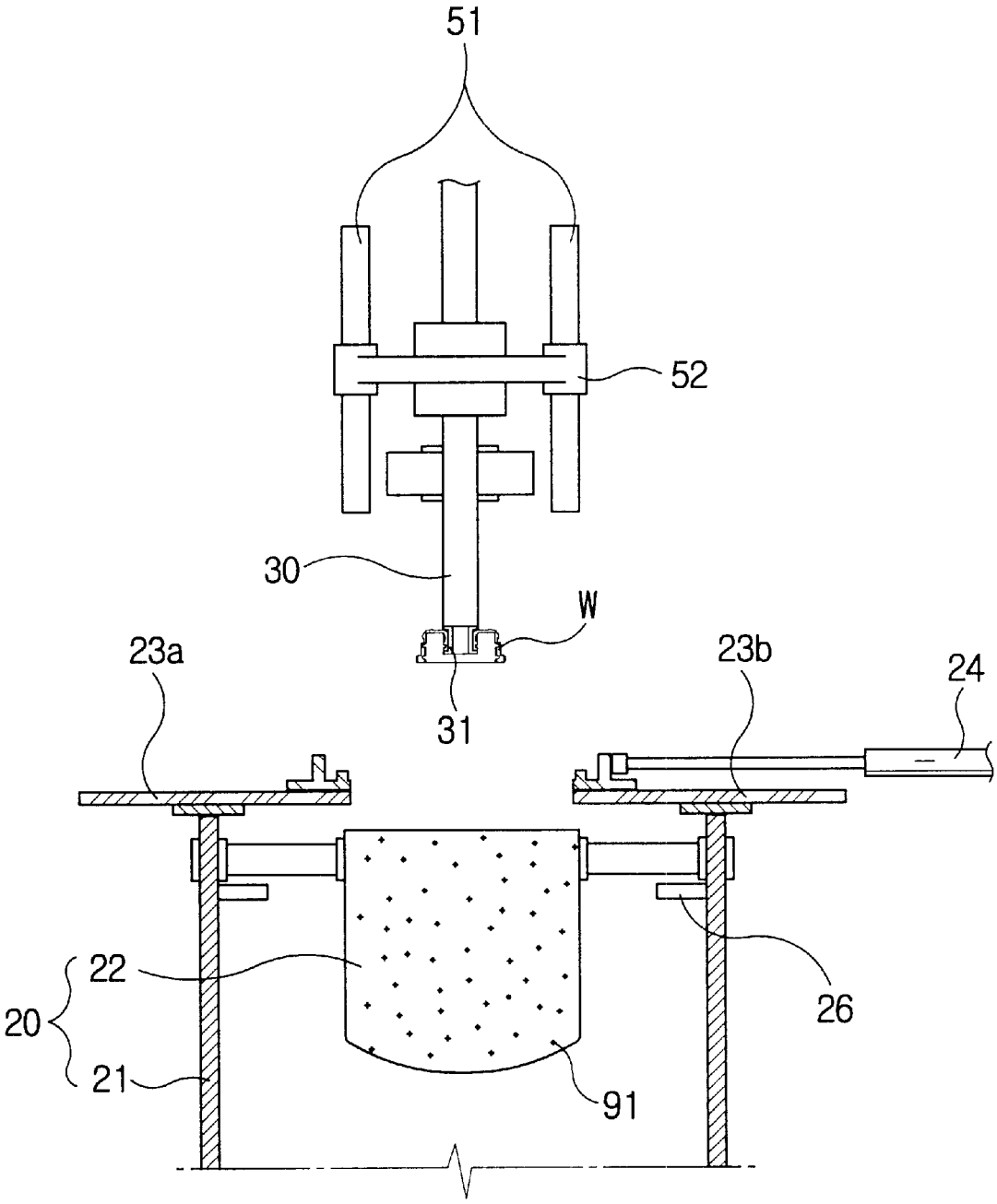
Figure 13C:
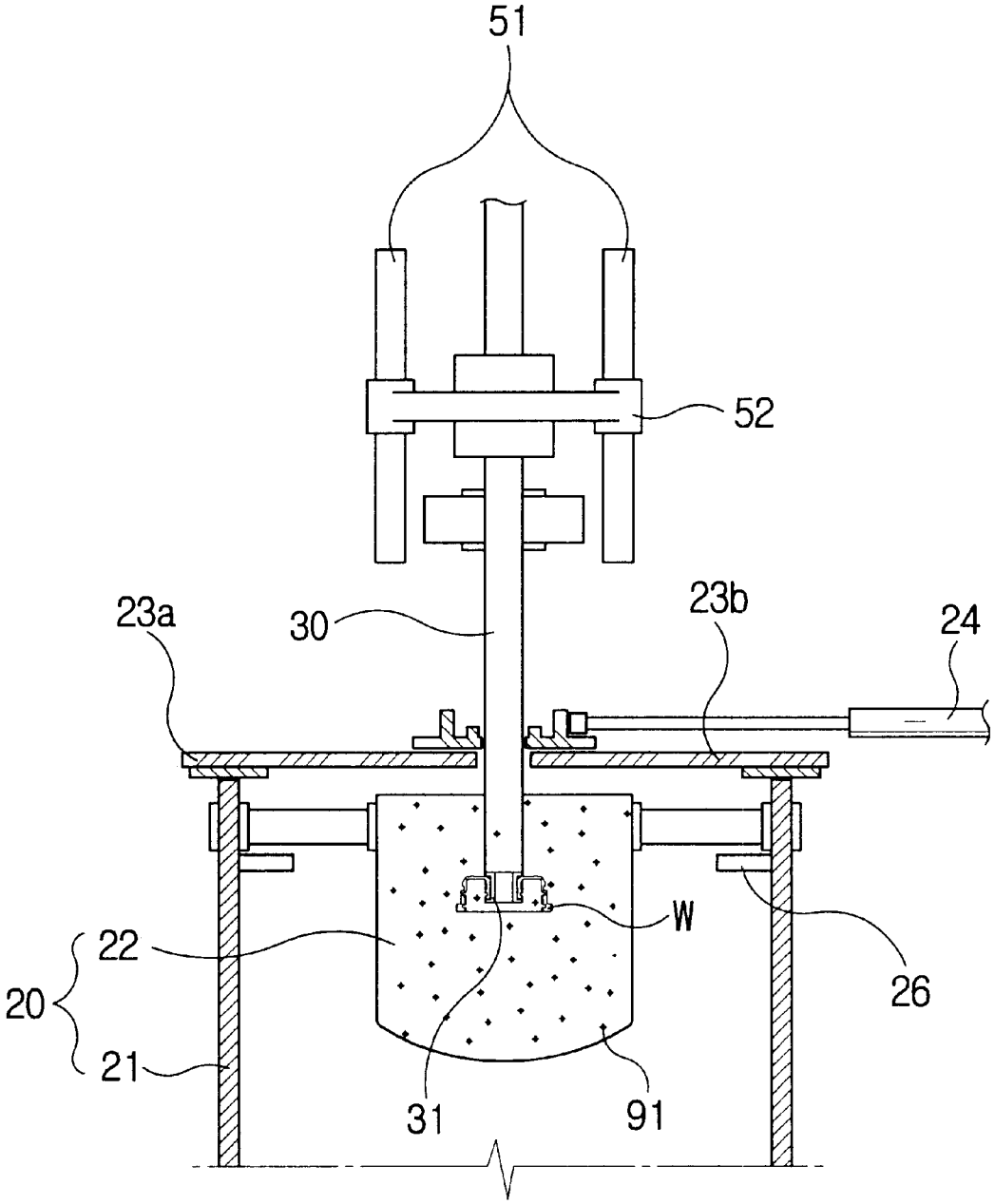

The elevating unit 50, as shown in FIG. 13*a* to FIG. 13*c*, includes a pair of guide rails 51 disposed up and down in the frame 10, an elevator plate 52 slidingly coupled to and guided along the guide rails 51, a ball screw 55 provided between the guide rails 51 and spirally coupled to the elevator plate 52, and an elevating motor 56 for driving the ball screw 55 to be rotated. A lower end of the ball screw 55 is rotatably supported through the elevator plate 52 to a supporting block 57 disposed in the frame 10.

Figure 8:
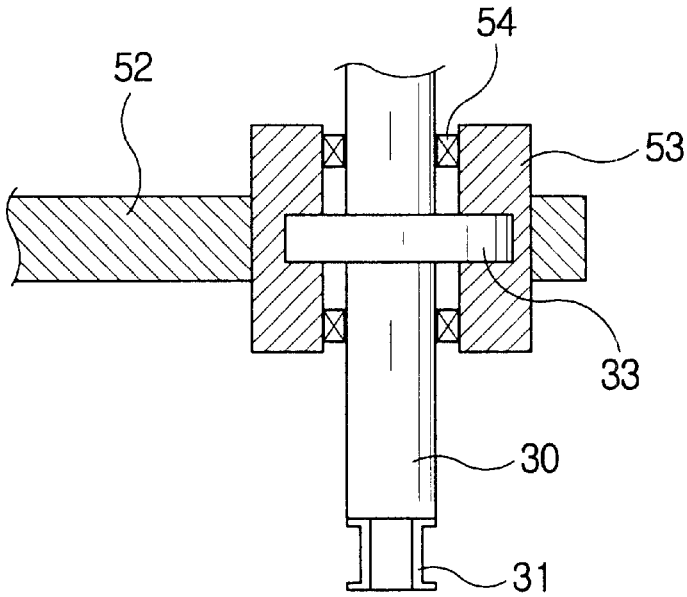
FIG. 8 is a sectional view for illustrating an elevating structure of a spindle.
Figure 14:
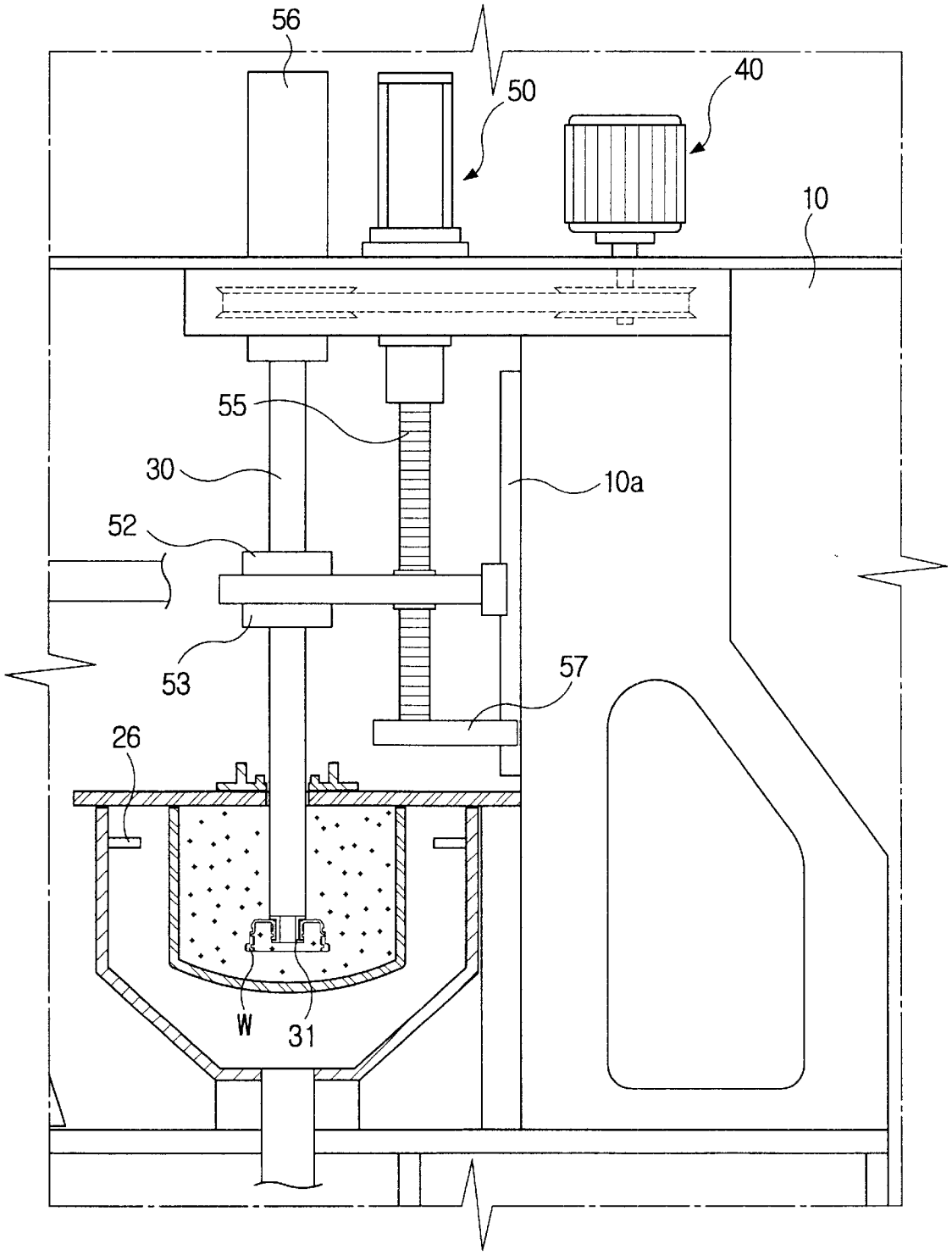
FIG. 14 is an expanded sectional view showing a state of deburring the workpiece by the media.

As seen from FIG. 14, the elevator plate 52 is slidingly coupled to the guide rails 51 on one side and to a slide surface 10*a* disposed in the frame 10 on the other side while the ball screw 55 is connected to a middle portion of the elevator plate 52. Also, the guide rails 51 are slidingly coupled to right and left sides of the elevator plate 52 as shown in FIG. 13, and the spindle 30 is coupled to a portion of the elevator plate 52 between the guide rails 51 in such a manner as shown in FIG. 8. Consequently, a back and forth swing movement of the elevator plate 52 can be prevented when the elevator plate 52 is moved up and down by the regular and reverse driving motor for elevation 56.

Referring to FIG. 8 again, the elevator plate 52 is provided with a supporting bush 53 fixed to its portion through which the spindle 30 penetrates, the supporting bush 53 rotatably receives the flange 33 fixed to the spindle 30, and bearings 54 are disposed between the spindle 30 and the supporting bush 53. Thus, the supporting bush 52 is also moved up and down according as the elevator plate 52 is raised and lowered by rotation of the ball screw 55. In turn, the spindle 30 to which the flange 33 is fixed is likewise moved up and down because the flange 33 is raised and lowered by the supporting bush 53 when the supporting bush 53 rises and falls.

Figure 12:
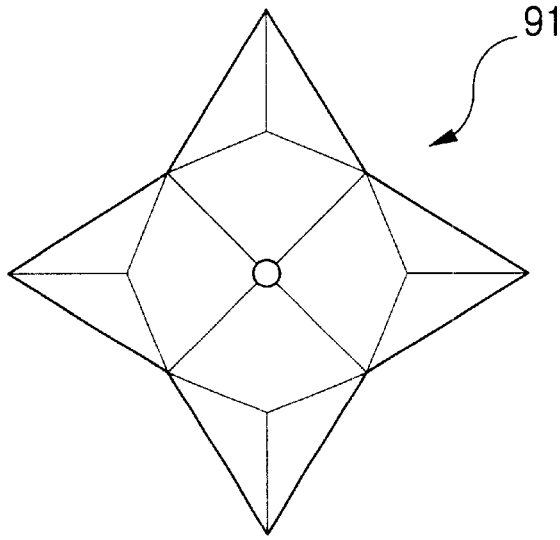
FIG. 12 is a perspective view of one example of media used in the device according to the present invention.

In the meanwhile, the media 91 may be of various shapes, but are preferably made of materials having high hardness such as cemented carbide alloys and have a polygonal or substantially star-like shape as shown in FIG. 12 for the sake of enhancing effect of burr removal. Also, a series of experiments by the present inventors show that it is preferable to mix the media 91 and the coolant 92 in the ratio of about 8:2.

The above-mentioned components of the device according to the present invention are controlled by means of a controller 100.

Now, a description will be given for operation of the inventive device for removing burrs from a workpiece.

First of all, the coolant 92 is supplied into the outer barrel 21 of the barrel 20 through the coolant supplying nozzles 26. If the coolant 92 reaches a proper level in the outer barrel 21, the level sensor detects this situation and sends a corresponding signal to the controller 100, and so the coolant supplying nozzles 26 come to stop the coolant supplying 10 action by the signal of the controller 100. By this, everything is ready for deburring of the workpiece W. At this time, the coolant 92 having been fed to the outer barrel 21 flows into the inner barrel 22 through the through holes 22*a* of the inner barrel 22.

If the coolant 92 flows into the inner barrel 22, the conveyor 80 on which the workpiece W is entrained conveys the workpiece W toward the loader 70, and the loader 70 grasps the workpiece W from the conveyor 80 and securely seats it on the jig 25 located over the barrel 20. After the workpiece W is securely seated on the jig 25, the workpiece W is detected by the workpiece sensing sensor (not shown), and the workpiece sensing sensor sends detection signals to the controller 100. The controller 100 delivers action signals to the elevating unit 50 so as to control the elevating unit 50 in accordance with the detection signals from the workpiece sensing sensor.

In the elevating unit 50, on the basis of the signals from the controller 100, the elevating motor 56 is driven to rotate the ball screw 55 in a regular direction and so the elevator plate 52 spirally coupled to the ball screw 55 is lowered by a certain distance with result that the spindle 30 connected to the elevator plate 52 by the flange 33 is also lowered. As the spindle 30 is lowered, the chuck 31 provided at the lower end of the spindle 30 clamps the workpiece W securely seated on the jig 25. If so, the elevating motor 56 is rotated in the reverse direction so as to slightly raise the spindle 30 as shown in FIG. 13*b*.

Thereafter, the piston of the door cylinder 24 for operating the door 23 located over the barrel 20 is retreated, so that the door members 23*a*, 23*b* connected to the piston of the door cylinder 24 are retreated to open the upper opening of the barrel 20. When the upper opening of the barrel 20 is opened, the elevating motor 56 is driven in the regular direction so as to lower the spindle 30, and thus the workpiece W clamped in the chuck 31 of the spindle 30 is positioned within the inner barrel 22 of the barrel 20 as shown in FIG. 13*c*. Once the workpiece W is positioned within the inner barrel 22, the piston of the door cylinder 24 advances forward to close the door 23 of the barrel 20.

In this situation, since the semi-circular recesses provided in the confronting surfaces of the door members 23*a*, 23*b* form the aperture when the door members 23*a*, 23*b* meet each other by forward movement of the piston of the door cylinder 24, the spindle 30 is in a state of passing through the so formed aperture. Accordingly, the aperture formed by the semi-circular recesses preferably has a diameter slightly larger than that of the spindle 30.

On the other hand, the workpiece W is embedded in the media 91 filled within the inner barrel 22 when it is introduced into the inner barrel 22. By driving the rotary motor 43 for rotating the spindle 30, the spindle 30 is rotated in the regular and reverse directions at regular intervals while being raised and lowered by a certain stroke by means of regular and reverse driving of the elevating motor 56 at regular intervals. Simultaneously, the inner barrel 22 is reciprocates in a horizontal direction by a reciprocating motion of the shaker 64 of the sliding unit 60.

Consequently, these rotating and elevating motions of the spindle 30 together with the right and left reciprocating motion of the inner barrel 22 bring frictional contacts between the workpiece W positioned within the inner barrel 22 and the media 91 contained within the inner barrel 22. Since the media 91 are formed of material having high hardness and the starlike or polygonal shape as stated above, the burrs produced in the process of the cutting work of the workpiece W are effectively removed by the frictional contacts between the media 91 and the workpiece W.

The burrs having been removed from the workpiece W may be adhere to the workpiece W due to static electricity generated by the friction between the media 91 and the workpiece W, but this adhesion of the burrs to the workpiece W due to the static electricity can be prevented by the fact that the media 91 is mixed with the coolant 92 of proper quantity. Besides preventing the adhesion of the burrs to the workpiece W due to the static electricity, the coolant 92 performs cooling of the media 91 so that the burr removal effect may not be reduced due to the friction. As stated above, the volume ratio between the outer barrel 21 filled with the coolant 92 and the inner barrel 22 filled with the media 91 is about 8:2, which induces quantity of the coolant 91 capable of effectively cooling the media 91 to be heated due to the frictional contacts with the workpiece W.

If the above-mentioned deburring work for one workpiece W is completed by use of the frictional contacts between the workpiece W and the media 91, the rotating and the elevating units 40, 50 stop their driving, respectively, and the upper opening of the barrel 20 is opened by the operation of the door 23. If so, the elevating motor 56 is driven to raise the spindle 30. The deburred workpiece W is discharged from the barrel 20 by the rising of the spindle 30, and is taken out toward the discharge conveyor by the loader 70.

From another point of view, after certain numbers of the workpieces W are deburred, the drain valve 28 provided in a lower portion of the barrel 20 is opened to discharge the coolant 92 containing the removed burrs of the workpiece W from the barrel 20 to outside through the coolant drain duct 27. With respect to this, after the coolant 92 containing the burrs is discharged from the barrel 20 and then the drain valve 28 is closed, a fresh coolant in certain quantity is supplied into the barrel 20, so that the burrs is more reliably discharged from the barrel 20.

Also, since the media 91 to be used in the inventive device are formed of the cemented carbide alloys, their abrasion and deformation with frequency of use almost never occur, and thus they can be used semi-permanently. In addition, due to high hardness of the media 91, the burr removal becomes reliable enough to require no separate manual works.

As described hereinbefore, according to the present invention, the burrs can be always removed reliably from the workpiece W without deformation of a tool with frequency of use, thereby requiring no separate human labors for removing residual burrs. Furthermore, the tool can be used semi-permanently without exchange thereof, which minimizes shutdown of the device due to the tool exchange, and the burrs removed from the workpiece can be reliably discharged out of the device.

Accordingly, not only productivity and reliability of products and rate of operation of the device can be improved, but also reduction of the number of processes and cut down of production cost can be expected by the present invention.

While the present invention has been illustrated and described under considering a preferred specific embodiment thereof, it will be easily understood by those skilled in the art that the present invention is not limited to the specific embodiment, and various changes, modifications and equivalents may be made without departing from the true scope of the present invention.

What is claimed is:

1. A device for removing burrs produced by cutting work from a workpiece comprising:

a frame constituting a main body of the device;

a barrel being located within the frame, receiving a plurality of media for removing the burrs from the workpiece, being supplied with a coolant for cooling the media and the workpiece, and being provided with a coolant drain duct for discharging used coolant;

a spindle extending from the frame toward the barrel and having a chuck for clamping the workpiece at its lower end;

wherein the means for rotating the spindle includes a regular and reverse driving-rotary motor disposed in an upper portion of the frame, a driving pulley disposed in the rotary motor, and a driven pulley spline-coupled to the spindle and connected to the driving pulley via a transmission belt;

means for rotating the spindle in regular and reverse directions, being spline-coupled to the spindle;

means for elevating the spindle so as to raise and lower the workpiece by a certain stroke within the barrel, being installed in the frame; and means for reciprocating the barrel in a horizontal direction.

2. A device according to in claim 1, wherein a volume ratio between an outer barrel and an inner barrel is about 8:2.

3. A device according to in claim 1, wherein the means for elevating the spindle includes a pair of guide rails disposed at an upper portion and a lower portion of the frame, an elevator plate guided along the guide rails and connected to the spindle, a ball screw spirally coupled to the elevator plate, and an elevating motor disposed in the frame so as to drive the ball screw in regular and reverse directions.

4. A device according to in claim 1, wherein the means for reciprocating the barrel includes a guide rod movably disposed in the frame so as to support the barrel, and a shaker reciprocating the guide rod by a certain stroke.

5. A device according to in claim 1, wherein the barrel has an outer barrel fixed to the frame and receiving the coolant, an inner barrel movably located within the outer barrel, filled with the media and provided on its outer circumferential surface with a plurality of through holes, and a door for opening and closing a upper opening of the outer barrel by operation of a door cylinder disposed in the frame.

6. A device according to in claim 5, wherein a door has a pair of door members cooperating with each other by the door cylinder, the door members are provided with internal teeth members having a symmetrical shape to each other, respectively, and the internal teeth members form a jig on which the workpiece is securely seated.

7. A device according to in claim 6, wherein surfaces of the door members confronting each other are formed with semi-circular recesses each of which has a radius slightly larger than that of the spindle.

8. A device according to in claim 1, wherein the device further includes a loader for securely seating the workpiece conveyed by a conveyor on a jig and taking out the workpiece after completion of deburring.

9. A device according to in claim 5, wherein coolant-supplying nozzles for supplying the coolant are provided on an inner surface of the outer barrel and a drain valve for opening and closing a coolant drain duct is provided on a bottom surface of the outer barrel.

10. A device according to in claim 9, wherein the outer barrel has a level sensor for detecting a level of the coolant in the outer barrel, and a coolant overflow tube for bypassing the coolant into the coolant drain duct when the coolant overflows.

11. A device according to in claim 1, wherein the media are formed of cemented carbide alloys and have a polygonal shape.

* * * * *